United States Patent [19]

Tanaka et al.

[11] Patent Number: 4,552,353

[45] Date of Patent: Nov. 12, 1985

[54] DOUBLE-FEED PREVENTION DEVICE IN PAPER FEEDING APPARATUS

[75] Inventors: Kazunori Tanaka, Atsugi; Mitsuru Yoshikawa, Zama, both of Japan

[73] Assignee: Duplo Seizo Kabushiki Kaisha, Japan

[21] Appl. No.: 563,353

[22] Filed: Dec. 20, 1983

[30] Foreign Application Priority Data

Dec. 20, 1982 [JP] Japan ..... 57-221955

[51] Int. Cl.[4] ..... B65H 3/52

[52] U.S. Cl. ..... 271/124

[58] Field of Search ..... 271/121, 124

[56] References Cited

U.S. PATENT DOCUMENTS 4,313,598 2/1982 DiBlasio ..... 271/124

FOREIGN PATENT DOCUMENTS 850580 9/1969 Japan .

131646 8/1982 Japan ..... 271/124

*Primary Examiner*—Richard A. Schacher

*Attorney, Agent, or Firm*—Pearne, Gordon, Sessions, McCoy, Granger & Tilberry

[57] ABSTRACT

A paper feeding apparatus is provided with a paper feeding roller and a paper separating plate mounted on an end of a spring-biased swingable lever. Paper sheets are separated, one sheet from the other, at a gap between the paper feeding roller and the paper separating plate. A guiding means is provided in opposition to a swingable part of the lever, and a stopper is interposed in a space between the swingable part of the lever and the guiding means. The stopper is movably biased into mechanical engagement with the swingable part of the lever, thereby to prevent double-feed of paper sheets by maintaining a predetermined extent of the gap between the paper feeding roller and the paper separating plate.

8 Claims, 9 Drawing Figures

DOUBLE-FEED PREVENTION DEVICE IN PAPER FEEDING APPARATUS

BACKGROUND OF THE INVENTION

The present inventions relates to a double-feed prevention device in a paper feeding apparatus, and more particularly, to an improved double-feed prevention device especially adapted to avoid the double-feed of paper sheets which tends to occur due to the wear of a surface of a paper feeding roller.

In paper feeding apparatus used for various machines such as printing, copying, paper folding and the like, it is highly desirable to feed single paper sheet from a stack of paper sheets placed on a paper feeding plate. There are many known prior art devices for single sheet feeding of paper.

A particularly reliable single sheet feed device is disclosed in Japanese Patent No. 850580. In accordance with this patent, a paper feeding roller is opposed by a paper separating plate having a friction member mounted thereon. The paper separating plate is resiliently biased by a lever toward the paper feeding roller. The paper sheets fed between the feeding roller and the friction member being separated mechanical engagement with the swingable part of the lever in the same manner as two sheets of paper are separated by hand by slipping one off the other with relative movement between the thumb and index finger.

The above prior art device requires careful selection of the force biasing the paper separating plate against the paper feeding roller since paper creasing and jamming results if the biasing force is too high or double sheet feed results if the force is too low. In order to improve the feed reliability of this device, an adjustable fixed mechanical stop is used to regulate the position of the paper separating plate. The stop is adjusted to prevent a gap between the friction member and the paper feeding roller from widening beyond a dimension or thickness corresponding with that of a single sheet of paper.

The use of such stops in prior feed devices has not been entirely satisfactory since wear of opposed members requires frequent adjustment of the stops. Further, the required adjustments are too delicate and troublesome to be done efficiently using conventional manual procedures.

SUMMARY OF THE INVENTION

A principal object of the present invention is to overcome the foregoing problems by providing an improved double-feed prevention device in paper feeding apparatus. In accordance with the improvements of the present invention, an automatic adjustment technique and apparatus are provided to compensate for wear of the paper feeding members. Thus, even after a surface of a paper feeding roller has worn due to use, such wear is sufficiently compensated to avoid double feed by automatic adjustment to limit the gap which can be defined between the paper feeding roller and the paper separating plate including the frictional member, if the plate is provided with a frictional member.

This object is achieved according to the present invention by stopper means operable to mechanically engage to one swingable or pivotable part of a swingable lever which carries the paper separating plate on one end thereof. The lever is resiliently biased in a first direction to maintain the paper separating plate against the paper feeding roller. A stopper biasing means arranged to movably bias the stopper means into mechanical engagement with the lever so as follows the lever moved in the first direction and thereby prevents the movement of paper separating plate away from the paper feeding roller.

These and other features of the present invention will be understood from the following description of the preferred embodiments made in connection with the accompanying drawings.

BRIEF DESCRIPTION OF THE DRAWINGS

FIG. 8 is an elevational view similar to FIG. 5 showing a modification of the first embodiment of the present invention.

DETAILED DESCRIPTION OF THE DRAWINGS

Figure 1:
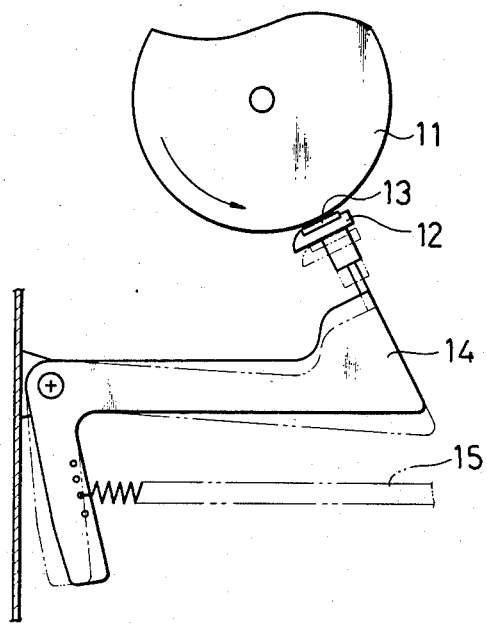
Fig - 1 PRIOR ART
FIG. 1 is a fragmentary, elevational side view of a double-feed prevention device in accordance with the prior art.
Figure 2:
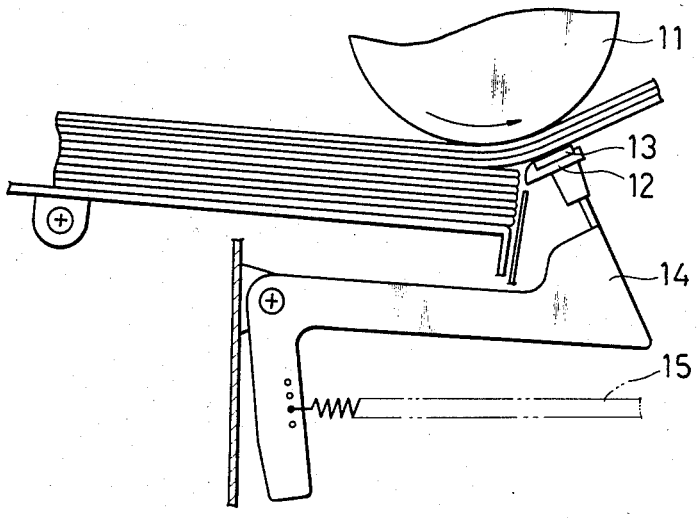
Fig - 2 PRIOR ART
FIG. 2 is a view similar to FIG. 1, but on an enlarged scale, showing a double sheet feed occurring in the device of FIG. 1.

The prior art teachings of Japanese Patent No. 850580, briefly summarized above, are discussed in greater detail below with reference to FIGS. 1 to 3 of the drawings.

The prior art double-feed prevention device includes as its major components a paper separating plate 12 having a frictional member 13 in opposition to a paper feeding roller 11. The paper feeding roller 11 is a rubber ring molded into the shape of a spur gear. The paper separating plate 12 is normally resiliently-biased by a lever 14 against the paper feeding roller 11, in front of the paper feeding table, using a restoring force such as that provided by spring 15. Thus, the paper sheets fed between the plate 12 and the roller 11 are separated by shear forces which cause one sheet to slip off the other.

The biasing force imposed by the spring 15 must be carefully selected. Since the paper may be creased or jammed if the force applied by the spring 15 is excessively high, there is a tendency to use a spring of relatively low biasing force. On the other hand, the use of a low biasing force spring may result in a tendency for the paper separating plate 12 to apply an insufficient force to the roller 11 and to be too easily separated therefrom. This makes reliable single sheet separation difficult and sometimes even causes double-feed when paper sheets having relatively more cohesive surfaces are to be fed in the apparatus as shown in FIG. 2.

Figure 3:
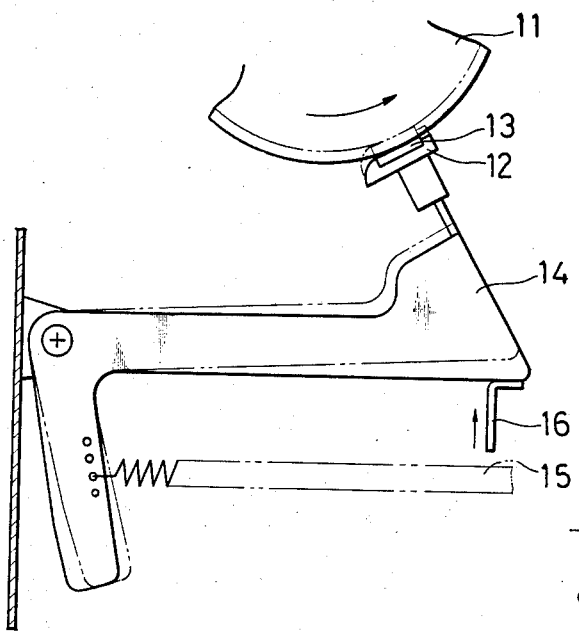
Fig - 3 PRIOR ART
FIG. 3 is a view similar to FIG. 1 showing the use of a stopper in such device in accordance with the prior art.

In resolution of such problems, the prior art teaches use of a stopper 16 arranged to engage one swingable part or arm of the lever 14 as shown in FIG. 3. The swinging range or pivotable movement of the lever 14 is thereby limited to prevent a gap between the frictional member 13 and the paper feeding roller 11 from widening beyond a spacing corresponding to the thickness of a single paper sheet. However, the gap permitted between the frictional member 13 and the paper feeding roller 11 may be progressively increased to a critical degree at which the double-feed readily occurs, since the surface of the roller 11 is worn during prolonged operation and the diameter of the roller is decreased. To avoid this, the stopper 16 must often be manually adjusted to a proper position. Such manual adjustment must be repeatedly performed since the wearing of the roller 11 progresses with time. For many users, such adjustment of the permitted gap is too delicate and troublesome.

Figure 4:
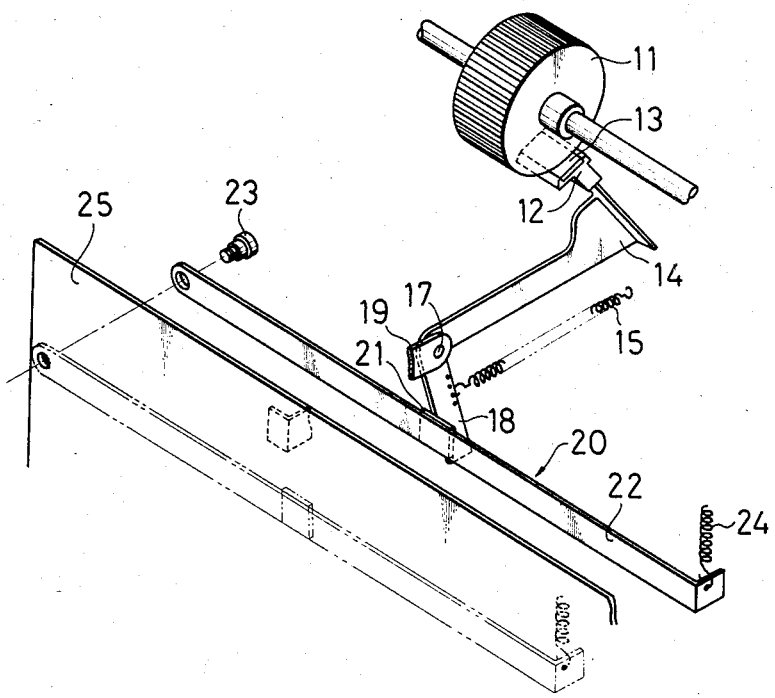
FIG. 4 is a schematic, perspective view of the device of FIG. 1 modified in accordance with the present invention.

Referring to FIG. 4, a double-feed prevention device according to the present invention is shown. (In the following discussion, the same reference numerals are applied to corresponding components or elements.) Accordingly, the device of the present invention also includes the paper separating plate 12 provided with frictional member 13 and arranged in opposition to the paper feeding roller 11. As described, the paper feeding roller 11 has a resilient surface, preferably of rubber, with a plurality of grooves thereon as shown in FIG. 4. The paper separating plate 12 is carried by an upper end of the lever 14 and the lever is swingably supported around a pivot 17 and biased by spring 15 to bear against the paper feeding roller 11.

The pivot 17 is supported in a supporter 19 which, in turn, is stationarily mounted on a housing wall 25 of the device. A swingable part or arm 18 of the lever 14 extends downwardly from the pivot 17 and is swingable in unison with the lever as a whole. The swingable part 18 is opposed to the housing wall 25. A stopper 20 is interposed between the swingable part 18 of the lever and the housing wall 25.

The stopper 20 comprises a lever 22 rotatably supported at one end by a shaft screw 23 threadedly secured to the housing wall 25 and upwardly biased at the other end by a relatively weak biasing force of a spring 24. The biasing force developed by the spring 24 is less than that developed by the spring 15. A butt strap 21 is mounted on the lever 22 at a middle portion corresponding with the position of the swingable part 18 of the lever 14. Thus, the stopper 20 comes in contact at the butt strap with the swingable part 18 of the lever 14, as the housing wall 25 serves as a guiding means for the lever 22.

Figure 5:
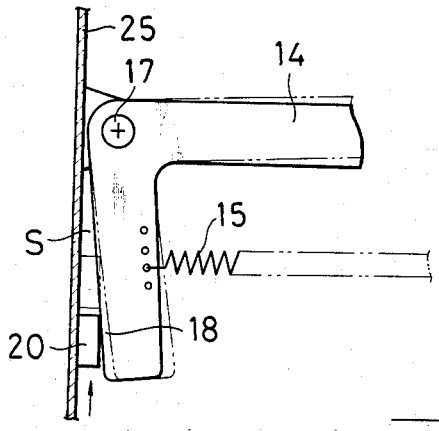
FIG. 5 is a fragmentary, elevational view of the device of FIG. 4 showing the operation of a stopper in accordance with the present invention.

Mutually opposed surfaces of the swingable part 18 of the lever 14 and the housing wall 25 serves as a guiding means which define therebetween a triangular and convergent space "S" (FIG. 5). Even at initial set-up with all the feed members being free of wear, the mutually opposed surfaces are not parallel to each other and the space S progressively tapers in a direction extending towards the pivot 17 of the lever 14.

The stopper 20 is biased into the space S in the direction of the tapering space width and converging surfaces for mechanical engagement with the swingable part 18 of the lever 14. The stopper 20 is moved upwards (in the direction indicated by the arrow in FIG. 5) under the moderate force of the spring 24 as the lever 14 swings for a first direction to enlarge the width of the space S. The stopper 20 thereby progressively slides into the space S over the stationary surface of the housing wall 25. The stopper operates between the surface of the housing wall 25 and the opposed surface of the swingable part 18 to restrict the movement of the lever 14 in a second direction, namely a clockwise direction as shown in FIG. 5 and thereby to limit the movement of the paper separating plate 12 away from the paper feeding roller 11.

In the event, for example, the surface of the paper feeding roller 11 has been worn, the paper separating plate 12 together with the frictional member 13 are biased radially inwardly toward the roller 11 by the spring 15 operating through the lever 14. At the same time, the swingable part 18 of the lever 14 which is pivotable together with the paper separating plate 12, is correspondingly displaced in a progressive manner under the force of the spring 14, as indicated in phantom outline in FIG. 5. Such displacement is followed by the stopper 20 which, in turn, is automatically displaced under the force of the spring 24 to its phantom outline position as shown in FIG. 5. Thus, the following displacement of the stopper 20 prevents the frictional member 13 being spaced from the paper feeding roller 11 by an amount larger than a predetermined extent, and the gap defined between the member 13 and roller 11 is maintained at a range corresponding with its initial range before the roller 11 has been worn. It is possible, therefore, to maintain the desired performance of paper feeding and simultaneously to avoid a double-feed of paper sheets caused by a wear of a surface in the paper feeding roller 11.

It should be understood that the spring 24 has a minimal affect upon the force biasing the paper separating plate 12 against paper feeding roller since the spring 24 provides only a moderate force. This assures that creasing and jamming of the paper sheets due to excessive biasing force is avoided.

Figure 6:
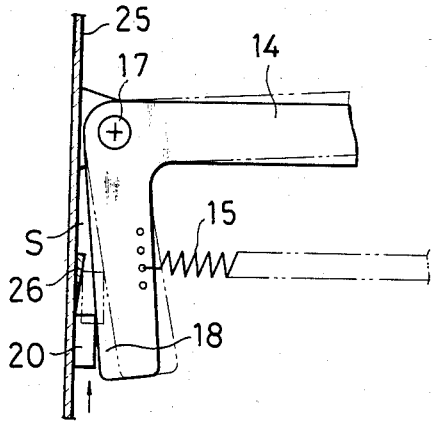
FIG. 6 is an elevational side view similar to FIG. 1 showing another embodiment of the double-feed prevention device according to the present invention.
Figure 6:
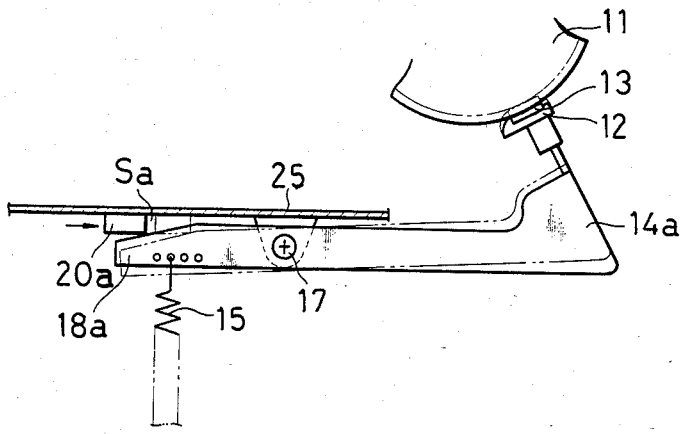
Figure 7:
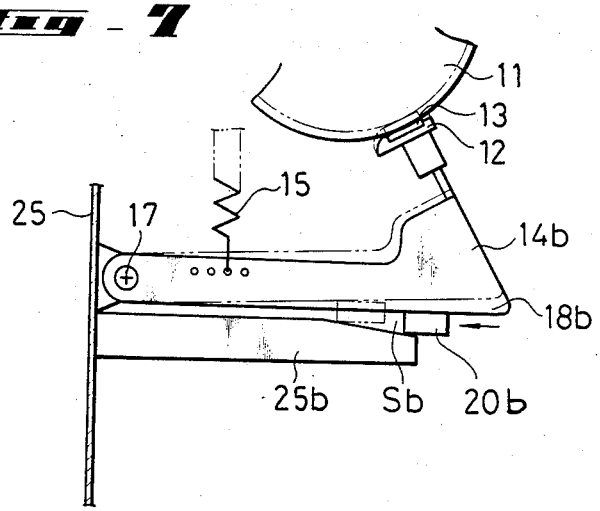
FIG. 7 is an elevational side view similar to FIG. 6 showing yet another embodiment of the present invention.

FIGS. 6 and 7, respectively, show different embodiments of the double-feed prevention device according to the present invention. In these figures, components similar to those described above are designated by the same reference numerals.

In the embodiment of FIG. 6, the L-shaped lever 14 is replaced by a linear lever **14*a*. A swingable part 18*a* of this lever 14*a* has an inclined surface adapted to be opposed by the housing wall 25. A stopper 20*a* is interposed in a space Sa defined between the inclined surface of the swingable part 18*a* and the housing wall 25 under a biasing force of a spring (not shown) which is arranged to move the stopper 20*a*** in the direction indicated by the arrow in FIG. 6.

In the embodiment of FIG. 7, the L-shaped lever 14 of the first embodiment is replaced by a cantilever **14*b*. A swingable part 18*b* of the lever 14*b* is positioned below the separating plate 12 and is adapted to be engaged with a stopper 20*b*. A guiding means 25*b* separately extends from the housing wall 25 in opposition to the swingable part 18*b*. The guiding means 25*b* includes an inclined surface adapted to be opposed to the swingable part 18 of the lever 14*b*. In a space Sb defined between the inclined surface and the swingable part 18*b*, there is interposed a stopper 20*b*** which is biased by a spring (not shown) in the direction indicated by the arrow in FIG. 7.

Although the operation of the embodiments of FIGS. 6 and 7 will not be described here in detail, their operation is apparent from the first embodiment. Accordingly, similar effects and advantages are obtained.

FIG. 8 shows a modification of the first embodiment. In this arrangement, a wedge-like body 26 projects from the housing wall 25 into the space S defined between the housing wall 25 and the swingable part 18 of the lever 14. This arrangement permits the displacement of the stopper 20 required to compensate for wear in the surface of the paper feeding roll 11 to be decreased. To that end, the body 26 is located in the movement path of the stopper 20 and biases the stopper to the right as shown in FIG. 8 to provide an increased pivotal movement of the swingable part 18. The same effect is also achieved by an alternative arrangement such as that in the embodiments of FIGS. 6 and 7. More particularly, the surface of the swingable part of the lever or the guiding means adapted to be engaged against the stopper is steeply in- clined.

Figure 9:
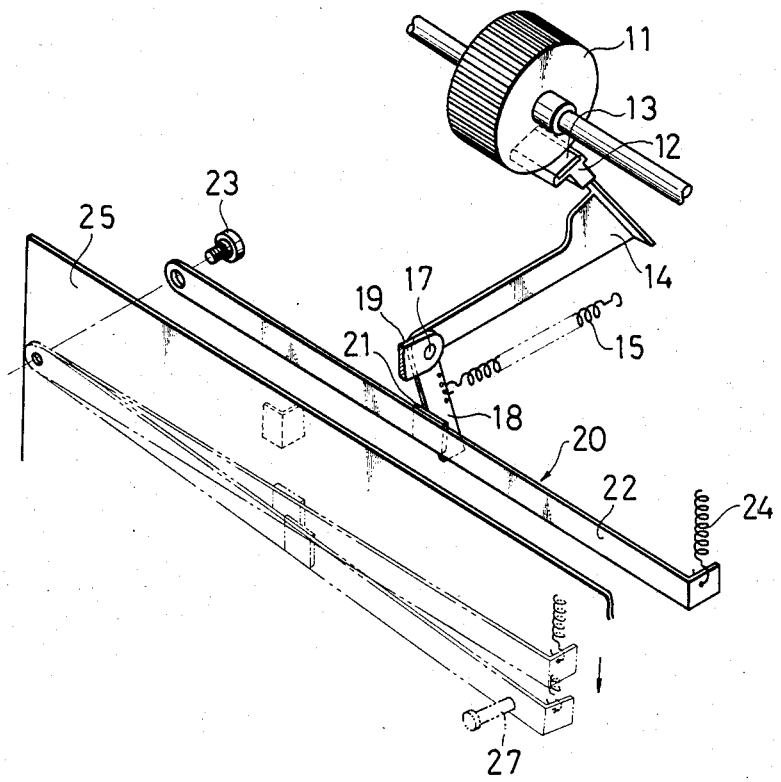
FIG. 9 is a perspective view similar to FIG. 4 showing a further modification of the first embodiment of the present invention.

FIG. 9 shows a technique for clearing a paper jam occurring between the paper feeding roller 11 and the paper separating plate 12 in the device of the first embodiment. If such a paper jam occurs, no further operations can be carried out unless the paper separating plate 12 is depressed downwardly and radially away from the roller 11 to remove the clogged paper sheets. However, the swingable part 18 of the lever 14 bears against the stopper 20 and thereby prevents the paper separating plate 12 from being depressed. Accordingly, the paper separating plate 12 can be depressed to remove the jammed paper only after the stopper 20 is retracted from the space S. This retraction of the stopper is achieved by moving the lever 22 downwardly in the direction indicated by the arrow in FIG. 9 through operation of a knob 27 mounted on a remote end of the lever 22. The downward pivotable displacement of the stopper 20, as shown in phantom outline, may be provided by direct manual manipulation of the knob 27 or through operative association with another mechanism.

Although the stopper 20 has been shown and described as having a rectangular cross-section is the respective embodiments, such cross-sectional form in not critical and may be modified.

The double-feed prevention device constructed according to the present invention enables the following effects to be achieved. First, provision of the movable stopper assures that, even after the paper feeding roller has been worn, the gap defined between the paper feeding roller and the paper separating plate is maintained at a condition corresponding to the initial condition. This assures that consistant performance of paper feeding can be maintained and avoids a double-feed of paper sheets. The present invention also avoids the required position-adjustment of the stopper every time the paper feeding roller and/or frictional member on the paper separating plate are repaired and/or replaced. In accordance with the present invention, a paper jam can be remedied or cleared merely by moving the lever of the stopper downwards to free the jammed paper sheets and then permitting the stopper to be automatically brought into the space to its optimum position without any specific position-adjustment of the stopper. In contrast with this simplified procedure, it is necessary to loosen or dismount the stopper in prior art devices in order to clear such a paper jam and to readjust the position of the stopper.

Although the preferred embodiments of this invention have been shown and described, it should be understood that various modifications and rearrangements of the parts may be resorted to without departing from the scope of the invention as disclosed and claimed herein.

What is claimed is:

1. A double-feed prevention device in a paper feeding apparatus including a paper feeding roller and a cooperating paper separating plate adapted to feed single sheet of paper therebetween from a stacked supply of sheets, which comprises said paper separating plate being carried on a lever means in pivotal movement toward and away from said paper feeding roller, a lever biasing means arranged to move said lever means in a first direction and bias said paper separating plate toward said paper feeding roller, a stopper means arranged to restrict the movement of said lever means in a second direction opposite to said first direction by mechanical engagement with a part of the lever means, and a stopper biasing means arranged to movably bias said stopper means into mechanical engagement with the lever means as said lever means moves in said first direction and thereby prevents the movement of said paper separating plate away from said paper feeding roller.

2. A double-feed prevention device as set forth in claim 1, wherein said stopper means and said stopper biasing means are arranged to limit widening of a gap which can be defined between said paper feeding roller and said paper separating plate to approximately the thickness of a single paper sheet to be fed.

3. A double-feed prevention device as set forth in claim 1, wherein said stopper means moves slidably on a stationary surface of guiding means by a force of said stopper biasing means, and said mechanical engagement occurs between said stopper means and a swingable part of said lever means.

4. A double-feed prevention device as set forth in claim 3, wherein both surfaces of said guiding means and said swingable part of lever means are arranged in a nonparallel relationship to each other, and forms a space converging along a predetermined direction and said stopper means being moved into said space in said predetermined direction.

5. A double-feed prevention device as set forth in claim 4, wherein said predetermined direction extends toward a pivot of said lever means and said stopper is spring-biased to be slidably moved substantially in said predetermined direction.

6. A double-feed prevention device as set forth in claim 4, wherein said guiding means comprises a housing wall of the apparatus.

7. A double-feed prevention device as set forth in claim 4, wherein said guiding means includes a wedge-like body projected into a movement path along which said stopper is moved into said space.

8. A double-feed prevention device as set forth in claim 4, wherein said stopper is retractable from its position within said space.

* * * * *

UNITED STATES PATENT AND TRADEMARK OFFICE

CERTIFICATE OF CORRECTION

PATENT NO. : 4,552,353

DATED : November 12, 1985

INVENTOR(S) : Kazunori Tanaka et al.

It is certified that error appears in the above-identified patent and that said Letters Patent are hereby corrected as shown below:

Column 1, lines 25 and 26, delete "mechanical engagement with the swingable part of the lever" and substitute therefor --with single sheet of paper from the other--; and Column 5, line 20, delete "in- clines" and substitute therefor --inclined--.

Signed and Sealed this

*Eighteenth* Day of *March 1986*

[SEAL]

*Attest:*

DONALD J. QUIGG

*Attesting Officer*

*Commissioner of Patents and Trademarks*